US007967972B2

(12) United States Patent
Glass et al.

(10) Patent No.: US 7,967,972 B2
(45) Date of Patent: Jun. 28, 2011

(54) ELECTRICAL CONNECTION TO IMPRESSED CURRENT ANODE IN CONCRETE CONSTRUCTION

(76) Inventors: Gareth Kevin Glass, Lichfield (GB); Nigel Davison, Coton-in-the-elms (GB); Adrian Charles Roberts, Chilwell (GB)

( * ) Notice: Subject to any disclaimer, the term of this patent is extended or adjusted under 35 U.S.C. 154(b) by 241 days.

(21) Appl. No.: 12/281,263

(22) PCT Filed: Feb. 28, 2007

(86) PCT No.: PCT/GB2007/050089

§ 371 (c)(1),
(2), (4) Date: Aug. 29, 2008

(87) PCT Pub. No.: WO2007/102021

PCT Pub. Date: Sep. 13, 2007

(65) Prior Publication Data

US 2009/0032410 A1 Feb. 5, 2009

(30) Foreign Application Priority Data

Mar. 7, 2006 (GB) ..... 0604545.4
Sep. 1, 2006 (GB) ..... 0617179.7

(51) Int. Cl.
*C23F 13/20* (2006.01)

(52) U.S. Cl. ..... 205/734; 204/196.2; 204/196.31; 204/196.33; 204/196.36

(58) Field of Classification Search ..... 204/196.19, 204/196.2, 196.21, 196.33, 196.34, 196.36; 205/734, 730

See application file for complete search history.

(56) References Cited

U.S. PATENT DOCUMENTS

| | | | | |
|---|---|---|---|---|
| 2,695,990 | A | 11/1954 | Sullivan | |
| 3,342,716 | A | 9/1967 | Anderson et al. | |
| 4,874,909 | A | 10/1989 | Velke | |
| 5,129,844 | A * | 7/1992 | Goto et al. | 439/778 |
| 5,236,377 | A * | 8/1993 | Goto | 439/779 |
| 6,007,356 | A | 12/1999 | Stein | |
| 2006/0105626 | A1 * | 5/2006 | Scott | 439/535 |
| 2006/0254799 | A1 * | 11/2006 | Gregorek | 174/74 A |

FOREIGN PATENT DOCUMENTS

| | | |
|---|---|---|
| EP | 0566206 | 10/1993 |
| GB | 860473 | 2/1961 |
| NL | 7604453 | 10/1977 |

OTHER PUBLICATIONS

Ebonex product Data Sheet, Fosroc Limited (see p. 3).
CP International durAnode system product list pp. 1 to 8 (see figures 1 to 3 and connection detail in technical data tables).

* cited by examiner

*Primary Examiner* — Bruce F Bell

(57) ABSTRACT

The connections to anodes used in impressed current electrochemical treatments of steel in concrete construction are at risk from rapid corrosion arising from induced anodic dissolution when these connections are embedded in reinforced concrete. A corrosion resistant connection that does not require any further protective insulation can be formed using titanium conductors [2,6] and connecting the conductors together at a conductor-conductor connection [5] using a clamping device comprising a non-metallic material wherein the clamping device only brings corrosion resistant material into contact with the conductors.

24 Claims, 3 Drawing Sheets

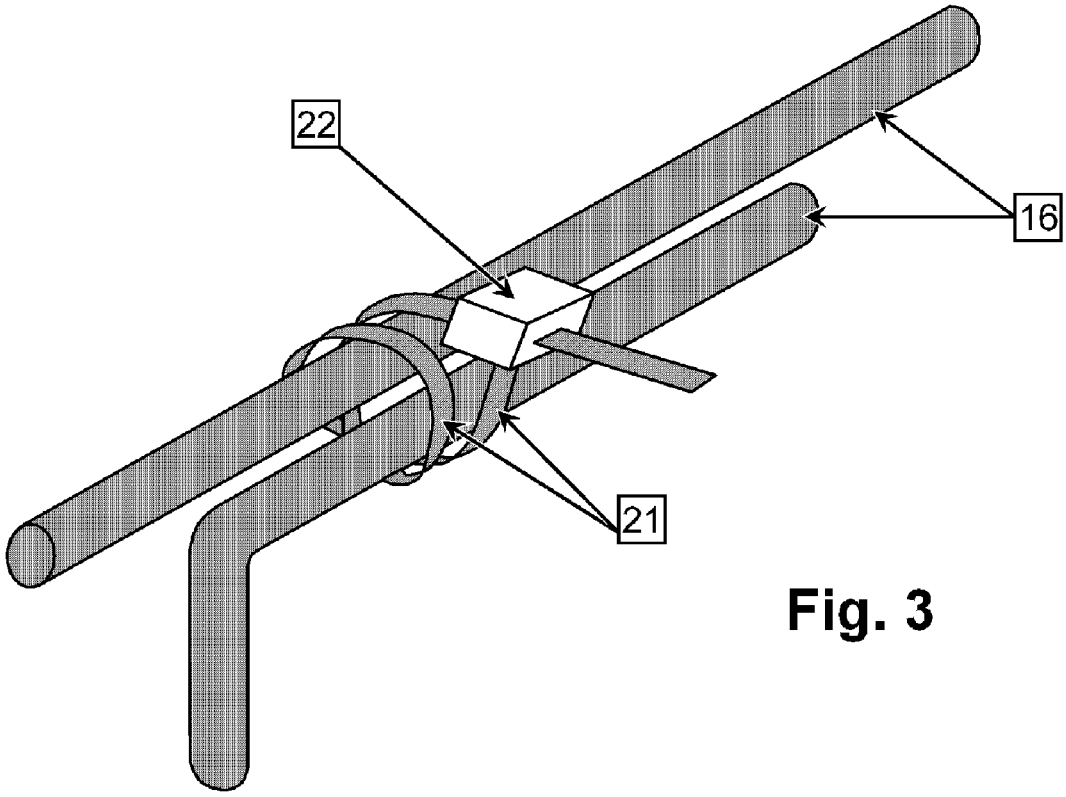
Fig. 3
Fig. 4
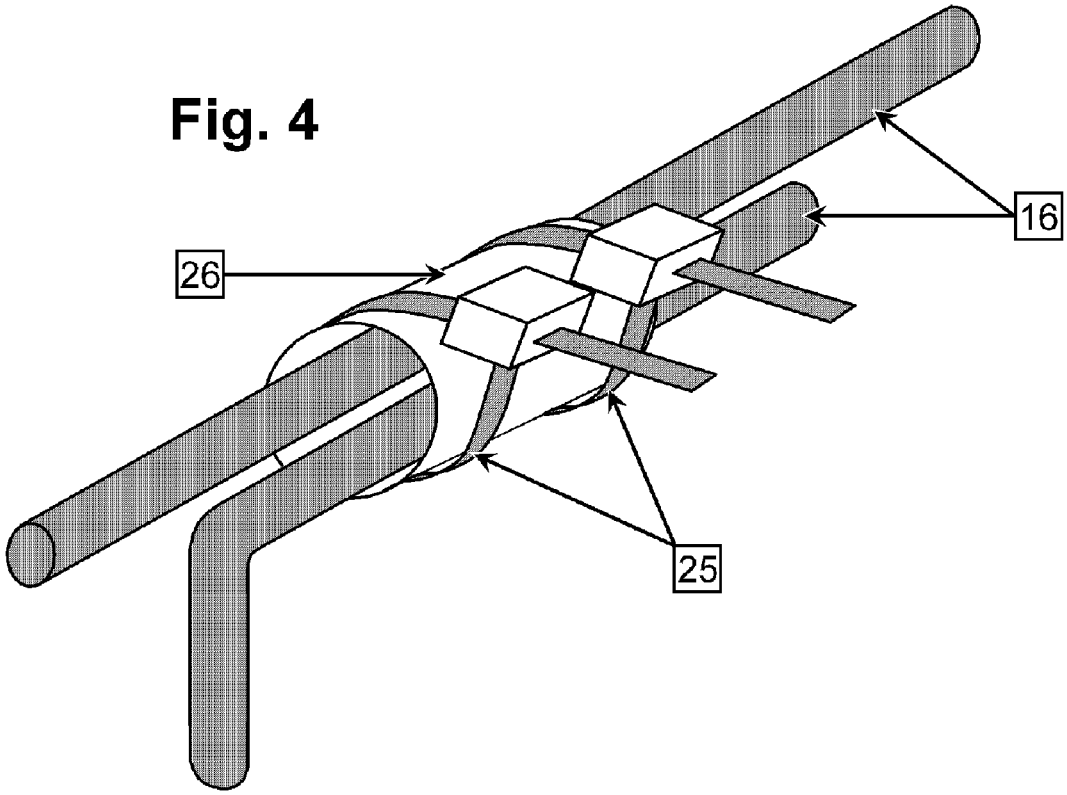

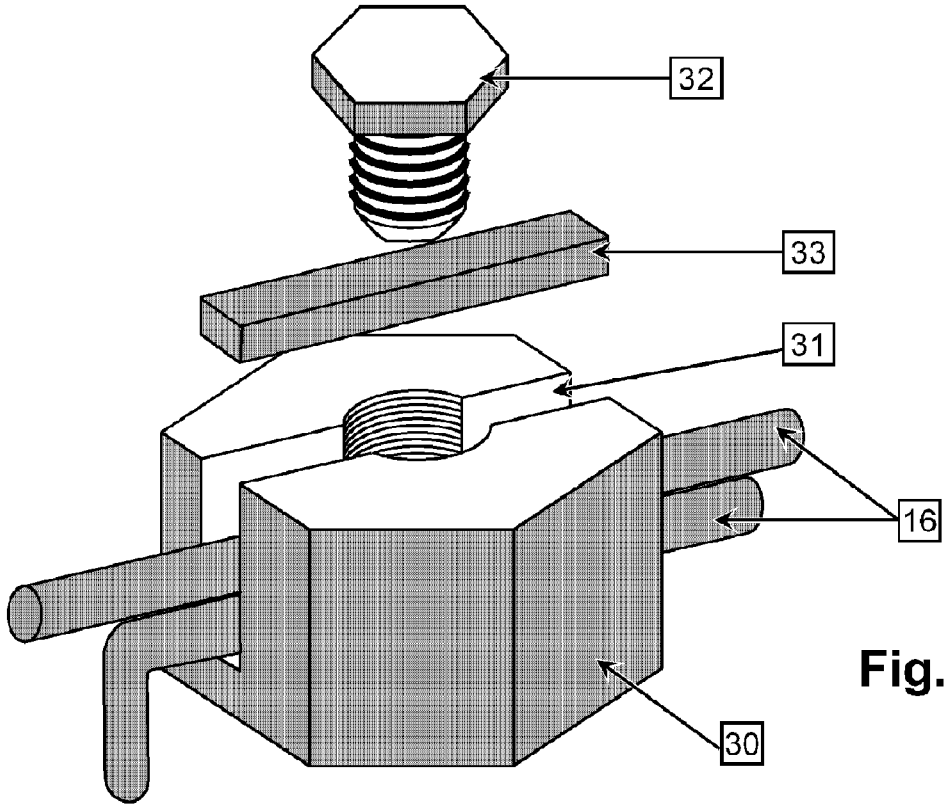
Fig. 5
Fig. 6
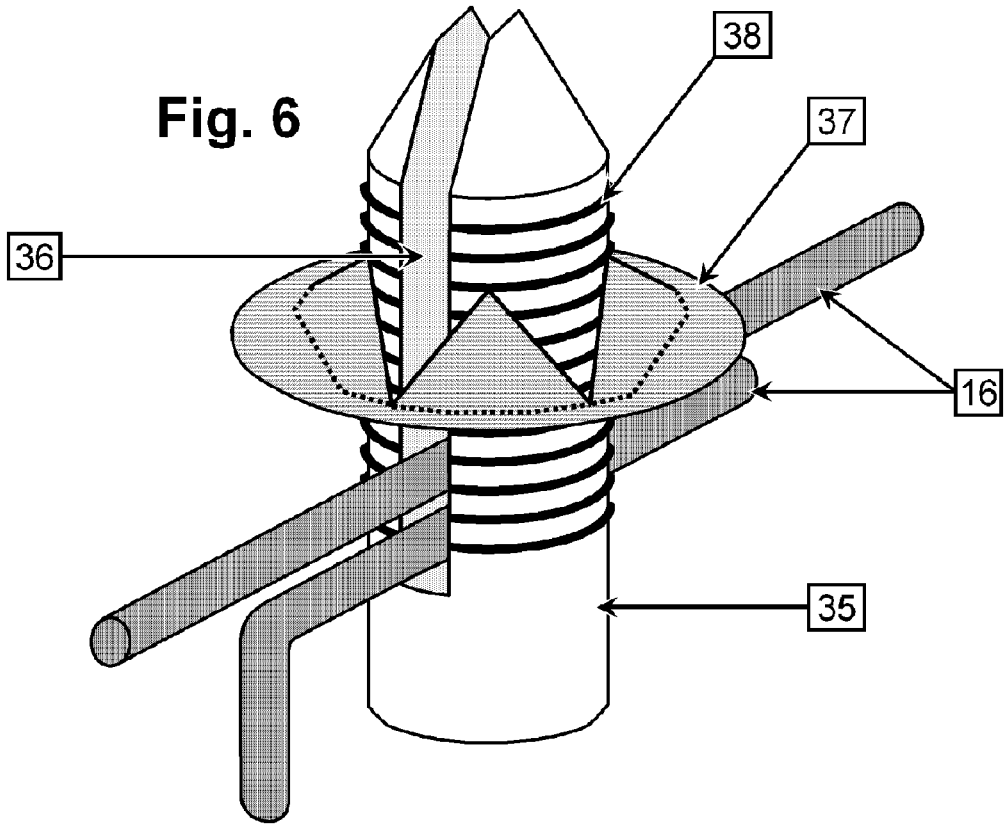

ELECTRICAL CONNECTION TO IMPRESSED CURRENT ANODE IN CONCRETE CONSTRUCTION

TECHNICAL FIELD

This disclosure is related to the electrochemical protection of steel in reinforced concrete construction and in particular to the connections that carry current from the positive terminal of a source of DC power to anodes used in impressed current electrochemical treatments commonly applied to steel in concrete.

BACKGROUND ART

Impressed current electrochemical treatments such as impressed current cathodic protection are widely used to protect steel in concrete. Current is driven to the steel from one or more electrodes (termed anodes) connected to the positive terminal of a source of DC power, inducing anodic reactions on the anode or anodes and cathodic reactions on the steel (the cathode). The anode system, which includes the anode and other items such as anode electric cabling, is a key part of most electrochemical treatment systems for steel in reinforced concrete construction.

TECHNICAL PROBLEM

Anodic reactions are aggressive to metallic components. Impressed current anodes used in conjunction with a source of DC power are commonly designed to withstand this aggressive effect or are designed with a view to anode corrosion occurring. The conductors and connections that carry the current from the positive terminal of a source of DC power to the anode are also at risk of corrosion. Copper, a common electrical conductor will, for example, corrode rapidly as the result of induced anodic dissolution reactions on its surface if it is not separated from the electrolyte in the surrounding environment with insulation. Furthermore, environments like concrete are aggressive to insulation and many types of insulation may deteriorate over time when exposed to alkaline concrete.

One solution to this problem is to use a robust insulation material or insulation system to separate the conductors and connections from the environment. This allows the use of conventional electrical cables with conventional cable splicing techniques. However concerns regarding the quality of insulation that can be achieved in some circumstances remain. The anode must make intimate contact with the electrolyte in the surrounding environment to function and the anodic conductor approaches the electrolyte as the conductor approaches the anode. Some anode assemblies are embedded within the concrete and the connections and conductors close to the anode will also be embedded within the concrete and are at a particularly high risk of corrosion.

Another solution is to use a corrosion resistant conductor, the principal example being the use of titanium as an electrical conductor. Titanium conductors remain passive over a wide range of positive potentials when in contact with the electrolyte in concrete and may therefore be used without insulation to connect the anode assembly to the positive terminal of a DC power supply in a number of different electrochemical treatments. Titanium conductors are usually supplied as single stranded wire. They have different physical properties such as resilience, conductivity and flexibility when compared to standard electrical cables. Because of their corrosion resistance, titanium conductors are often supplied and used without an insulating sheath.

A requirement placed on the connection between titanium wires is that it has an inherent corrosion resistance similar to that of the wire. This restricts the available methods of connecting titanium wires. Existing methods of connecting titanium wires include welding, titanium crimp connections (as commercialised with the Ebonex® product by the Fosroc® Group of companies) or slotted titanium bolts attached to impressed current anodes (as commercialised with the durAnode® product by Cathodic Protection International ApS).

Titanium is difficult to work with and while it is available in common forms such as wire, custom fittings made from titanium are a relatively expensive component of an anode system. An inexpensive, durable, robust, corrosion resistant connection detail that is simple to apply to connect titanium conductors used in anode systems and that does not compromise the high resistance to corrosion of the titanium conductor connecting the positive terminal of a power supply to an anode system is disclosed in this work.

SUMMARY OF THE TECHNICAL SOLUTION

A connection detail between titanium electrical conductors or single stranded titanium wires with a high resistance to corrosion may be achieved by avoiding electrical contact between the titanium conductors and any other metal that might corrode within the connection detail.

It is also noted that these connections would rarely carry currents above 1000 mA. In one arrangement, compact discrete anode assemblies are embedded in cavities in the concrete. Each anode assembly includes a titanium wire connected to an anode element and this titanium wire is connected to another separate titanium wire that connects a plurality of anode assemblies to the power supply. In this case the individual wire to wire electron conducting connections would typically carry maximum currents as low as 2 mA to each embedded compact discrete anode depending on the type of electrochemical treatment and at least one wire passes through connections to several anode assemblies in this example.

Because the currents are small, no contact between the titanium conductors and any other metallic conductor is required to enhance the conductivity of the connection. Contact between the conductors and any corrodible material is therefore easily avoided. A pressed connection detail between the two conductors would be sufficiently conductive to pass the small current on to the anode assembly. Such a pressed connection may be achieved using a small clamping device comprising a corrosion resistant non-metallic material that is characterised by the property that it can clamp the conductors together. For the purposes of this work, a corrosion resistant material is a material that suffers no more corrosion than a material that remains passive while in contact with the electrolyte in the concrete and while connected to the anode in the impressed current electrochemical treatment of reinforced concrete.

The clamping device comprises a corrosion resistant non-metallic material and only corrosion resistant material within the clamping device makes contact with the conductors. The clamping device may, for example, be formed out of a corrosion resistant polymer. Plastics and polymers tend to be durable in aggressive environments, are relatively cheap materials and are much easier to form into a required shape than titanium. One example is a plastic nut and bolt with a slot cut into the shaft of the bolt. A clamping device that only brings corrosion resistant material into contact (physical and electrical if electrical conductors are present within the clamping device) with the titanium wires may be embedded within the concrete cover without the need for any further protective insulation.

The non-metallic material within the clamping device may optionally be a structural non-metallic material in that it has a structure that restrains the reaction to the pressure pressing the conductors into direct contact with each other. In this case the clamping device will preferably be constructed entirely from this material to minimise cost. The use of costly corrosion resistant conductive material that might be included within the structure of the clamping device to improve the connection achieved by the clamping action will at least be minimised through the use of a structural non-metallic material.

The non-metallic material within the clamping device may optionally be an insulating material that insulates other metal components within the clamping device from the titanium conductors. This minimises the corrosion risk to other metals that are cheaper and easier to form than titanium and that may be used to form a robust structural element in the clamping device.

The use of titanium conductors (cables or wires) with no insulating sheath in conjunction with the clamping device removes the need to remove the local insulation, or the need to cut through the insulation at the connection using a cutting edge normally made from a metal strip to achieve a connection. The use of such a connection detail is particularly suited to connecting a titanium wire that is part of a compact discrete anode assembly to other titanium wires in an anode system because of the small currents that pass through such connections. The use of a compact discrete anode assembly that includes a titanium wire allows the anode element to be embedded at depth within the concrete and connected through the titanium wire to a second conductor near the surface of the concrete.

Accordingly the present invention provides, in one aspect, a use of a clamping device to form a corrosion resistant electrical connection to carry current from the positive terminal of a source of DC power to an anode installed in a reinforced concrete structure which use comprises pressing at least two conductors into direct contact with each other wherein the conductors are titanium conductors and the clamping device comprises a corrosion resistant non-metallic material and only a corrosion resistant material within the clamping device makes contact with the conductors.

The present invention also provides, in another aspect, a method of forming a corrosion resistant electrical connection to carry current from the positive terminal of a source of DC power to an anode installed in a reinforced concrete structure which comprises using a clamping device to press at least two conductors into direct contact with each other wherein the conductors are titanium conductors and the clamping device comprises a corrosion resistant non-metallic material and only a corrosion resistant material within the clamping device makes contact with the conductors.

The present invention also provides, in another aspect, a combination adapted for use in accordance with the above use comprising an anode element and a conductor and a clamping device wherein the conductor is a titanium conductor connected to the anode element and extending away from the anode element to form an anode assembly and the clamping device is adapted to press the conductor into direct contact with at least one other conductor and the clamping device comprises a corrosion resistant non-metallic material and the clamping device is adapted to contact the conductor only with corrosion resistant material within the clamping device.

A preferred non-metallic material is a corrosion resistant polymer that may be a fibre reinforced corrosion resistant polymer. The force that presses the conductors together is preferably applied using a clamping device made from a corrosion resistant polymer. Any corrodible metal components in the clamping device are separated from the titanium conductors by a layer of insulation. The titanium conductors are preferably un-insulated conductors and may at least in part consist of wire. One titanium conductor is preferably connected to a compact discrete anode element and forms a compact discrete anode assembly. One example of the connection comprises locating the titanium conductors in a slot in one component of the clamping device and twisting a second component of the clamping device on to the first component to press the titanium conductors into contact with each other. Another example of the connection comprises forming a loop around two or more titanium conductors using a flexible elongated strip with a locking mechanism and tightening the loop to press the titanium conductors together to form the electrical connection where the locking mechanism maintains the tension in the loop after it has been tightened.

BRIEF DESCRIPTION OF THE DRAWINGS

The invention is described with reference by way of example to the drawings in which:

FIG. 3 illustrates the use of a cable tie to form an electrical connection between titanium conductors.

FIG. 4 illustrates the use of two cable ties to form an electrical connection between titanium conductors.

FIG. 5 illustrates the use of a slotted nut with a matching bolt to form an electrical connection between titanium conductors.

FIG. 6 illustrates the use of a slotted stud and press-fit or star washer to form an electrical connection between titanium conductors.

MODE OF THE INVENTION

Figure 1:
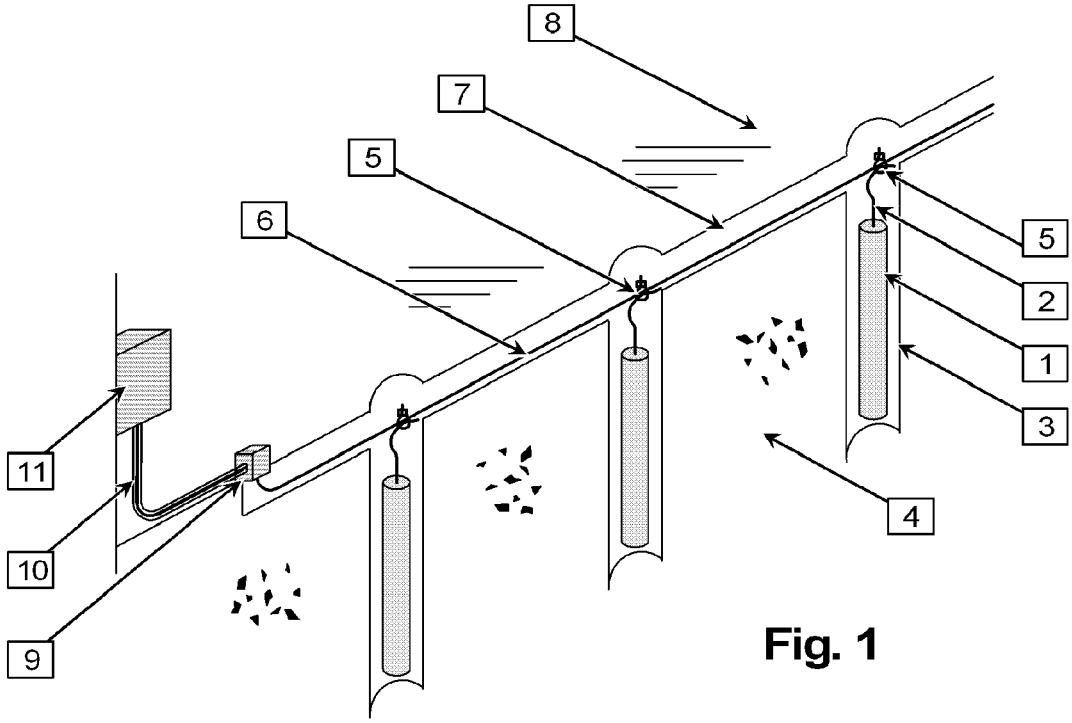
FIG. 1 illustrates an application of discrete anode assemblies in the electrochemical treatment of steel in concrete.

FIG. 1 illustrates an application of compact discrete anode assemblies in an impressed current electrochemical system applied to reinforced concrete. A section through the concrete is shown. Compact discrete anode assemblies comprising an anode element [1] and a titanium conductor [2] are embedded in a porous material in cavities [3] usually formed by drilling holes in the concrete [4]. In this example, the anode element is a compact discrete anode element which is a type of anode element particularly suited to this method of connection, although the connection detail may also be used with larger anode elements. The titanium conductors of each anode assembly are connected through a connection [5] to another longer titanium conductor [6] often embedded in an embedding material in a slot [7] cut into the concrete surface [8] to hide this detail from view. This longer titanium conductor [6] will typically pass through a series of connections [5] to a junction box [9] where it will be connected to a standard electrical cable that may run through conduit [10] to the positive terminal of a source of DC power in a housing [11] located elsewhere on the structure. Appropriately robust junction boxes and conduit may be used outside the concrete to exclude the environment from the conductors. Only the connections to the anode system are shown in FIG. 1. Connections to the steel reinforcement and monitoring sensors, also required by the electrochemical system, are not shown.

Titanium is preferably used as the conductor when the conductor is buried in a cavity in the concrete. It is the preferred conductor connected to an anode element in an impressed current electrochemical treatment. It has a high resistance to corrosion and will resist induced anodic dissolution if the conductor makes contact with the electrolyte in the environment. The connection between the titanium conductors must also have a high resistance to anodic dissolution to utilise the benefit resulting from the use of corrosion resistant titanium.

Some compact discrete anode assemblies for use in impressed current electrochemical treatments of steel in concrete are rated to deliver maximum currents of as little as 2 mA. In any case it is unlikely that the current off a discrete anode assembly will exceed 250 mA. This relatively small current is the maximum current that passes through the conductor to conductor connection to a discrete anode assembly. A sufficiently conductive low current connection can readily be achieved by pressing the titanium conductors together.

One titanium conductor will typically be used to link several anode assemblies together. This conductor therefore passes through several pressed connections such that both ends extend substantially beyond at least one pressed connection. At least one pressed connection to this conductor is formed between, but away from, the ends of this conductor. It is preferable that this pressed connection may be achieved without access to the ends of this conductor. It is preferable that the conductor enters and leaves the connection on opposite sides of the connection.

A clamping device is used to exert the force pressing the titanium conductors into electrical contact with each other. The clamping device is a distinct item that is preferably separate or separable from the conductors and anode element to maximise the flexibility of the connection location and method of connection.

The clamping device is preferably formed around the conductors and is tightened to clamp the conductors together. Other metal will, in many cases, not be required to enhance the conductivity of the pressed connection. A pressed conductor to conductor connection that uses no metal to achieve the connection other than that in the conductors is particularly suitable for connecting the titanium conductors attached to compact discrete anodes to other titanium conductors because of the low current that flows through such a connection. Thus the clamping device preferably consists at least in part of a corrosion resistant non-metallic material. This material is preferably an insulator. Examples of this material include organic or inorganic polymers that may be fibre reinforced, and hardened inorganic cements including macro defect free cement that may be fibre reinforced. The preferred non-metallic material is a corrosion resistant polymer or fibre reinforced polymer. The non-metallic material will preferably have a structure that is adapted to restrain the pressure that presses the conductors together and/or adapted to insulate the titanium conductors from another element with a structure adapted to restrain the pressure that presses the conductors together.

In this way the use of either costly or of corrodible metals within the clamping device may be minimised or avoided. A corrosion resistant non-metallic material may be used in many cases. If cheaper corrodible metals are present, for example, to increase the tensile strength of the clamping device restraining the reaction to the compression between the conductors, they may be isolated from the titanium conductors with a layer of insulation to enhance their durability. The use of costly materials may be limited to only what is needed to enhance the conductivity of the connection by forming the structural element of the clamping device from a cheaper corrosion resistant non-metallic material that can be readily formed into an appropriate shape.

It is preferable that the position of the clamping device on one titanium conductor not physically connected directly to the anode element can be adjusted after the clamping device has been formed around the conductors. This adjustment consists of moving the clamping device relative to at least one conductor. The adjustment of position may be achieved after the clamping device is formed around the conductors but before it is tightened. This allows final adjustments to be made in the location of the pressed connection on at least one conductor. For example, it may be preferable to locate the clamping device close to or within the end of a cavity containing a compact discrete anode assembly. It is preferable that, after the clamping device has been tightened to press the conductors together, it can be loosened to adjust the location of the connection on at least one of the titanium conductors.

It is preferable that the clamping device is either flexible such that it can be wrapped around the conductors before being tightened, or that it is rigid and contains an opening such as a slot into which the conductors are placed before the clamping device is tightened to squeeze the conductors together. It is preferable that the clamping device can be formed around the conductors without access to any conductor ends.

When the clamping device comprises a rigid material that cannot be wrapped around the conductors, it will preferably consist of at least 2 components. One component will preferably contain an opening into which the conductors are placed and a second component will have an adjustable connection to the first component such that it can be adjusted to exert and vary the force that presses the conductors together in the opening. For example, the two components may have matching screw threads that are utilised to connect the components together and to provide a continuously adjustable clamping action that is achieved by twisting the second component relative to the first component. The opening in the first component is preferably an opening such as a slot that allows the conductors to pass through the assembled clamping device.

When the clamping device comprises a flexible material that is wrapped around the conductors and tightened to press the conductors together, it is preferable that it contains a locking element on one end of the wrap such that a portion of the other end of the wrap that has passed around the conductors can be connected to the locking element to lock the tension into the tightened wrap. When an elongated flexible strip of material is used, it is preferable to wrap the flexible strip around the conductors more than once to improve the connection.

Non-limiting examples of the clamping device include a combination of a plastic nut and bolt where the nut or the bolt contains a slot into which the conductors are placed, a cable tie that can be wrapped around the conductors and tightened and a plastic rivet or stud and press-fit or star washer where the rivet contains a slot into which the conductors are placed. The use of these clamping devices in the connection between the titanium conductors is now discussed further with reference to FIGS. 2 to 6.

Figure 2:
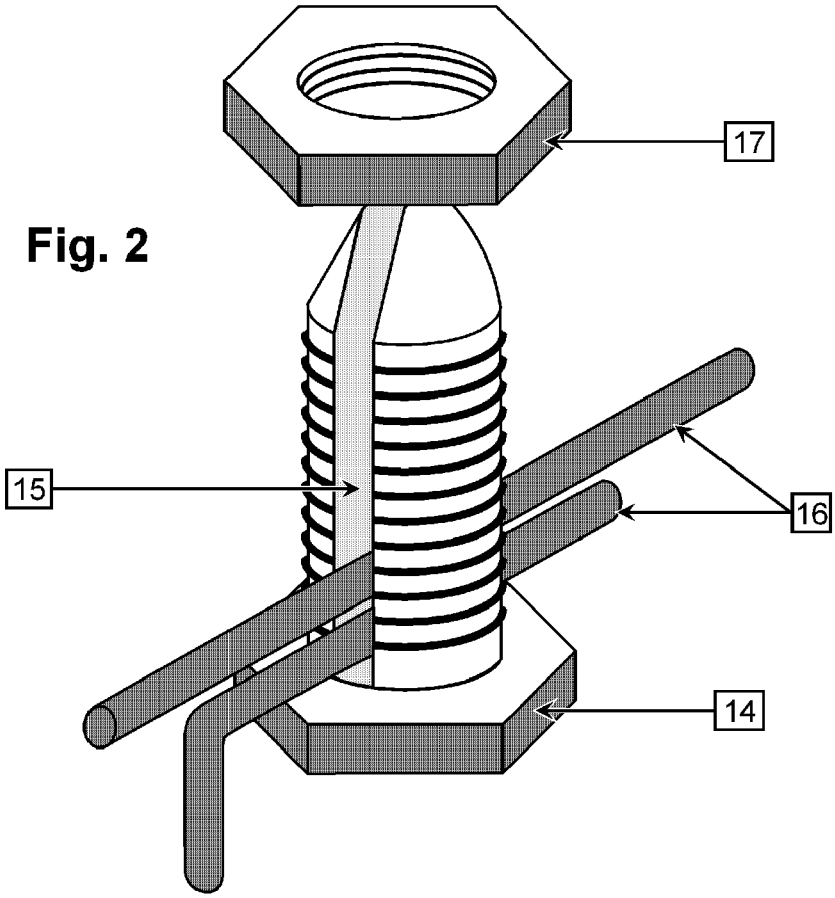
FIG. 2 illustrates the use of a slotted bolt and matching nut to form an electrical connection between titanium conductors.

FIG. 2 shows one example of the connection detail. In this example a bolt [14] made from a corrosion resistant polymer has a slot [15] into which the titanium conductors [16] are placed. The bolt preferably consists of a corrosion resistant polymer and the bolt may be readily formed by cutting a slot into a commercially available nylon bolt. The titanium conductors would typically be a conductor carrying current from the positive terminal of a DC power supply to anodes in a particular zone of the concrete structure and a conductor connected to an anode element in that zone as part of a preformed anode assembly. A nut [17], also made from a corrosion resistant polymer is then tightened onto the bolt to press the titanium conductors together in the slot to form an electrical connection. Twisting the nut onto the bolt provides a continuously variable tightening action and a relatively high force can be applied to press the conductors into contact with each other in this arrangement. The nut may also be loosened to allow the connection point between the conductors to be moved to a different location on at least one of the titanium conductors.

FIG. 3 shows an example of the use of a flexible plastic cable tie in the connection detail. A cable tie [21] is wrapped around two titanium conductors [16] and one end of the tie is passed through the locking element [22] on the other end of the tie. The tie is then tightened to press the titanium conductors together to form an electrical connection. As the tie is tightened, the locking element prevents the tie from being loosened.

Commercially available plastic cable ties need to be modified to improve the compression force that can be delivered to small diameter conductor bundles. Firstly, the locking element on commercially available ties tend to be fairly rigid and relatively large when compared to a cable bundle comprising two 1 mm diameter single stranded titanium wires. Secondly the locking element clips on to ridges on the tie and the loop formed by the tie around a small cable bundle is closed in a stepwise manner as opposed to a continuous manner. The smallest distance by which the loop may be adjusted is the distance between two adjacent ridges on the tie and may represent a significant percentage change in the length of the loop. These problems can be overcome by forming a plastic cable tie with a more acute angle, preferably less than 45 degrees, between the two ends of the loop where they meet the locking element as well as by wrapping the tie several times around the cable bundle. The titanium wires will then be pulled on to the locking element and the stepwise adjustment is spread over a longer length of the loop around the wires making the percentage change in the length of the tie loop smaller.

FIG. 4 shows another example of the use of cable ties in the connection. Two titanium conductors [16] pass through the loops formed by cable ties [25]. A corrosion resistant, insulating sheath [26] is placed between the ties and the titanium conductor. The sheath may be used to distribute the force of the cable ties over a longer length of the pair of conductors to increase the area of the connection. The sheath may also hold the conductors in place while the cable ties are tightened. It is preferable that the sheath [26] is split down its length so that it can be installed around the conductors without the need to have access to the ends of the conductors. When the sheath is present, the cable ties could comprise a stainless steel as the sheath isolates the cable tie from the titanium conductors. If the sheath is not present the cable ties preferably would consist of a corrosion resistant polymer.

FIG. 5 shows a nut [30] made from a corrosion resistant polymer that has a slot [31] into which the titanium conductors [16] are placed. A bolt [32] is screwed into the nut [30] to press the conductors [16] together in the slot [31]. A spacer [33] may be placed between the bolt and the conductors to distribute the force on the conductors over a larger length.

FIG. 6 shows another example of the connection detail in this disclosure. In this case a stud [35] made from a corrosion resistant polymer has a slot [36] into which the titanium conductors [16] are placed. A press-fit or star washer [37], comprising a disc of a corrosion resistant polymer with a hole through which the stud is passed such that the washer grips the stud preventing its removal is then pressed onto the stud to press the titanium conductors together to form a compression connection. Ridges [38] on the stud would improve the grip between the washer and the stud. Ridges comprising a screw thread would allow fine adjustment to be made to the pressure exerted by the press-fit washer by twisting it on the stud. It would also allow the washer to be undone to adjust the location of the connection on at least one of the titanium conductors.

The invention claimed is:

1. A method of forming a corrosion resistant electrical connection to carry current from the positive terminal of a source of DC power to an anode installed in a steel reinforced concrete structure to protect the steel in the concrete structure which method comprises pressing at least two conductors into direct contact with each other by tightening a clamping device around the conductors wherein the conductors are titanium conductors and the clamping device comprises a corrosion resistant non-metallic material and the corrosion resistant non-metallic material in the clamping device has at least one structure selected from the list consisting of:

a structure that restrains the reaction to the pressure that presses the conductors together, a structure that insulates the conductors from an element within the clamping device that has a structure that restrains the reaction to the pressure that presses the conductors together.

2. A method as claimed in claim 1 wherein the corrosion resistant non-metallic material in the clamping device has a structure that restrains the reaction to the pressure that presses the conductors together.

3. A method as claimed in claim 2 wherein the corrosion resistant non-metallic material comprises a corrosion resistant polymer.

4. A method as claimed in claim 3 wherein the corrosion resistant non-metallic material comprises a fibre reinforced corrosion resistant non-metallic material.

5. A method as claimed in claim 1 wherein the corrosion resistant non-metallic material comprises an insulator and only insulating material makes contact with the conductors.

6. A method as claimed in claim 1 wherein one of the two conductors is connected to a compact discrete anode element to form a compact discrete anode assembly with the conductor extending away from the anode element.

7. A method as claimed in claim 1 wherein the clamping device is formed around the conductors without using the conductor ends.

8. A method as claimed in claim 1 wherein at least one conductor is a bare conductor that does not include an insulating sheath.

9. A method as claimed in claim 1 wherein the clamping device is loosened after it has been tightened to move the position of the clamping device on at least one of the conductors.

10. A method as claimed in claim 1 wherein the clamping device is flexible and is wrapped around the conductors more than once.

11. An anode assembly and clamping device steel protector combination for the protection of steel in steel reinforced concrete comprising an anode assembly and a clamping device wherein the anode assembly comprises a titanium conductor connected to an anode element and extending away from the anode element and the clamping device is arranged to press the titanium conductor into direct contact with at least one other titanium conductor and the clamping device comprises a corrosion resistant non-metallic material and the corrosion resistant non-metallic material in the clamping device has at least one structure selected from the list consisting of:

a structure that restrains the reaction to the pressure that presses the titanium conductor into direct contact with at least one other conductor, a structure that insulates the titanium conductor from an element within the clamping device that has a structure that restrains the reaction to the pressure that presses the titanium conductor into direct contact with at least one other conductor.

12. An anode assembly and clamping device steel protector combination as claimed in claim 11 wherein the non-metallic material has a structure that restrains the reaction to the pressure that presses the titanium conductor into direct contact with at least one other conductor.

13. An anode assembly and clamping device steel protector combination as claimed in claim 12 wherein the non-metallic material comprises a corrosion resistant polymer.

14. An anode assembly and clamping device steel protector combination as claimed in claim 13 wherein the non-metallic material comprises a fibre reinforced corrosion resistant polymer.

15. An anode assembly and clamping device steel protector combination as claimed in claim 13 wherein the clamping device comprises a threaded bolt and matching threaded nut.

16. An anode assembly and clamping device steel protector combination as claimed in claim 13 wherein the clamping device comprises a stud and matching press-fit washer.

17. An anode assembly and clamping device steel protector combination as claimed in claim 13 wherein the non-metallic material comprises a flexible wrap arranged to be wrapped around the titanium conductor.

18. An anode assembly and clamping device steel protector combination as claimed in claim 17 wherein the flexible wrap is arranged to be tensioned and the clamping device includes a locking element to lock tension into the flexible wrap.

19. An anode assembly and clamping device steel protector combination as claimed in claim 11 wherein the non-metallic material is an electrical insulator that insulates any metallic components within the clamping device from the titanium conductor.

20. An anode assembly and clamping device steel protector combination as claimed in claim 11 wherein the titanium conductor comprises a wire.

21. An anode assembly and clamping device steel protector combination as claimed in claim 11 wherein the anode assembly comprises a compact discrete anode assembly.

22. An anode assembly and clamping device steel protector combination as claimed in claim 11 wherein the clamping device is arranged to be formed around the titanium conductors without using the ends of the titanium conductor.

23. An anode assembly and clamping device steel protector combination as claimed in claim 11 wherein the clamping device is arranged to be loosened after it has been tightened to move the position of the clamping device.

24. An anode assembly and clamping device steel protector combination as claimed in claim 11 wherein the titanium conductor is located in a slot in the clamping device.

* * * * *